United States Patent [19]

Wanninger et al.

[11] Patent Number: 4,488,916

[45] Date of Patent: Dec. 18, 1984

[54] CAST EXPLOSIVE CHARGE COMPOSITION

[75] Inventors: Paul Wanninger, Adelsberg; Ernst Kleinschmidt, Schrobenhausen, both of Fed. Rep. of Germany

[73] Assignee: Messerschmitt-Bölkow-Blohm GmbH, Fed. Rep. of Germany

[21] Appl. No.: 534,130

[22] Filed: Sep. 20, 1983

[30] Foreign Application Priority Data

Sep. 22, 1982 [DE] Fed. Rep. of Germany ..... 3234978

[51] Int. Cl.[3] ..... C06B 45/00

[52] U.S. Cl. ..... 149/2; 149/18; 149/92; 149/105; 149/110

[58] Field of Search ..... 149/2, 18, 92, 105, 149/110

[56] References Cited

U.S. PATENT DOCUMENTS

| | | | |
|---|---|---|---|
| 2,982,641 | 5/1961 | Dawson et al. | 149/105 X |
| 3,297,503 | 1/1967 | Hoffmann et al. | 149/105 X |
| 4,000,021 | 12/1976 | Voigt | 149/107 X |
| 4,284,442 | 8/1981 | Voigt | 149/105 X |

*Primary Examiner*—Stephen J. Lechert, Jr.
*Attorney, Agent, or Firm*—McGlew and Tuttle

[57] ABSTRACT

A cast explosive charge composition comprises trinitrotoluene (TNT) as a fusible component, at least one further energy carrier as solid filler, and a finely pulverized inert solid substance which is present in an amount of from 0.01 to 5% by weight, said inert solid substance having a specific surface of 10 to 1200 $m^2$ per gram.

5 Claims, 1 Drawing Figure

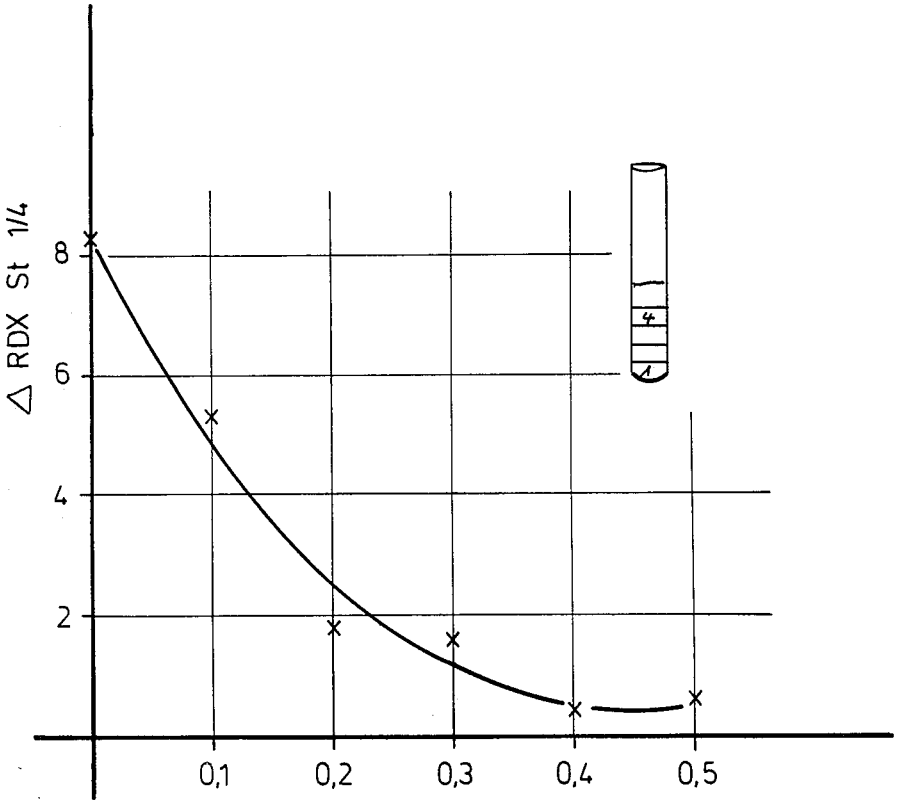
Δ RDX St 1/4
8
6
4
2
0,1
0,2
0,3
0,4
0,5

CAST EXPLOSIVE CHARGE COMPOSITION

FIELD AND BACKGROUND OF THE INVENTION

This invention relates in general to explosive charges and in particular to a new and useful cast explosive charge composition.

As solid fillers, particularly nitramines, nitric acid esters, and metal powders, such as aluminum powder may be provided.

German OS No. 23 00 655 discloses a cast explosive charge of TNT, comprising a plasticizer intended to reduce the segregation. Another energy carrier in the form of a solid filler, and a conventional stabilizer may be added to this prior art charge. As stabilizer or desensitizer, also dispersed inert solid substances may be considered, for example, finely dispersed calcium phosphate having a specific surface of 1 $m^2$ per gram.

The sedimentation of solid fillers is a considerable problem in the casting of TNT explosive charges. That is, not only the blasting effect but also the mechanical properties of the charge are thereby unfavorably affected since in general, the zone where the solid filler, such as the aluminum powder accumulates, is more frangible. Also, the sensitivity to shelling of the explosive charge is increased by sedimentation. Primarily, however, such a sedimentation or segregation affects the reproducibility of properties of the explosive charge.

Attempts have been made to prevent a sedimentary segregation by a proper temperature conduction during the casting and cooling process, and/or by gradual casting. This, however, is a very complicated and expensive technology. Moreover, the segregation can thereby be avoided only partly.

SUMMARY OF THE INVENTION

The present invention is directed to a cast explosive charge which can be obtained with most simple means and in which virtually no segregation of components occurs.

The fact that substances having a large specific surface, namely of 10 to 1200 $m^2$ per gram, preferably 10 to 500 $m^2$ per gram prevent the solid fillers from sedimenting and thus the components of the explosive charge from segregating, is entirely surprising. One explanation may be that substances with thus large specific surfaces permanently comprise sorbed gases, especially air, even after a treatment in vacuum, which gas then adheres to the solid fillers during the casting operation as gas bubbles, thereby exerting on them an upward force similar to the buoyancy in a flotation process, thus counteracting the sedimentation.

As a substance having a large specific surface, particularly soot is taken into account in the inventive explosive charge, since a great variety of different kinds of soot of definite properties is on the market which offers an excellent opportunity to choose a soot best suitable for the respective explosive charge. The soot content amounts preferably to 0.01 to 0.1% by weight.

Aside from soot or carbon black, aerosil, aluminum silicates, rutile, and the like, may be employed in the inventive explosive charge as substances with a large specific surface.

Accordingly, it is an object of the invention to provide an improved explosive charge composition which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a graph indicating segregation of an explosive charge as plotted against the amount of soot.

DESCRIPTION OF THE PREFERRED EMBODIMENT

The invention provides a cast explosive charge which can be obtained by simple means and in which virtually no segregation of components occurs.

The following is an example of how an inventive explosive charge may be manufactured:

40 g of TNT are melted, kept at a temperature of 95° C. and mixed with 60 g of hexogen while stirring. Then, under continued stirring, 400 mg of acetylene black are added to the mixture kept at 95° C. The resulting mixture is then cast into a mold and allowed to cool therein down to the room temperature.

The FIGURE is a graph wherein the segregation of an explosive charge is plotted against the added amount of soot.

The explosive charge of this example, which has been manufactured in accordance with the above example, contained 40% by weight of TNT and 60% by weight of hexogen; however, the charge contained unequal amounts of soot, namely 0.1, 0.2, 0.3, 0.4 and 0.5% by weight, as indicated by the graduation on the x axis.

About 10 ml of the explosive mixture having a temperature of about 95° C. were cast into a test tube which was kept at a temperature of about 80° C. and then allowed to cool down within the test tube to the room temperature in a water bath.

The test tube, as indicated in the graph at the right hand side above, was filled to about one half. Upon solidification, the cast charge body was removed from the test tube and divided in five zones (of about 1 to 2 cm in height) as also shown in the graph. The zones are numerated 1 to 5 from below, i.e. from the bottom of the test tube. The lowermost zone, thus zone 1, and the fourth zone from below, thus zone 4, were analyzed as to their hexogen content. This content was determined by elutriatiang the TNT with toluene, whereupon the hexogen was filtered off and weighed.

The ordinate of the graph shows the difference ($\Delta$RDX) in the amount of hexogen between zone 1 and zone 4 in percent by weight. It is evident that in zone 1 which contained no soot, 8% by weight more of hexogen has been found than in zone 4, while with an addition of only 0.2% by weight of soot, the hexogen segregation has been reduced to 2% by weight, and with an addition of 0.4 to 0.5%, to a negligible value of about 0.5% by weight.

While a specific embodiment of the invention has been shown and described in detail to illustrate the application of the principles of the invention, it will be understood that the invention may be embodied otherwise without departing from such principles.

We claim:

1. A cast explosive charge composition, consisting essentially of trinitrotoluene (TNT) forming a fusible component, at least one further energy carrier comprising a solid filler, and a finely pulverized inert solid substance which is present in an amount of from 0.01 to 0.1% by weight, said inert solid substance having a specific surface of from 10 to 1200 $m^2$ per gram.

2. A cast explosive charge composition according to claim 1, wherein said trinitrotoluene comprises an amount of from 15 to 40% by weight, and including trimethylene-trinitroamine (hexogen) forming another energy carrier in an amount of 85 to 60% by weight, and wherein said solid substance comprises soot.

3. A cast explosive charge composition according to claim 1, wherein said trinitrotoluene comprises an amount of from 20 to 28% by weight and said energy carrier comprises an amount of 80 to 72% by weight.

4. A cast explosive charge composition according to claim 1, wherein said inert solid substance comprises soot, said soot being a highly cross link gas black particularly acetylene black.

5. A cast explosive charge composition according to claim 1, wherein said solid substance comprises an aerosil.

* * * * *